US011103404B2

(12) United States Patent
MacKenzie et al.

(10) Patent No.: US 11,103,404 B2
(45) Date of Patent: Aug. 31, 2021

(54) SLOUCH CORRECTION DEVICE AND METHOD

(71) Applicant: MACKENZIE HEALTH CARE TECHNOLOGIES LTD., Musquodoboit Harbour (CA)

(72) Inventors: Matthew MacKenzie, Musquodoboit Harbour (CA); Gabriel J. W. Aliphat, Musquodoboit Harbour (CA)

(73) Assignee: MACKENZIE HEALTH CARE TECHNOLOGIES LTD., Musquodoboit Harbour (CA)

( * ) Notice: Subject to any disclaimer, the term of this patent is extended or adjusted under 35 U.S.C. 154(b) by 194 days.

(21) Appl. No.: 16/069,006

(22) PCT Filed: Jan. 11, 2017

(86) PCT No.: PCT/CA2017/000004
§ 371 (c)(1),
(2) Date: Jul. 10, 2018

(87) PCT Pub. No.: WO2017/120659
PCT Pub. Date: Jul. 20, 2017

(65) Prior Publication Data

US 2019/0021927 A1 Jan. 24, 2019

(30) Foreign Application Priority Data

Jan. 11, 2017 (CA) ..... 2917234

(51) Int. Cl.
*A61G 7/10* (2006.01)
*A61G 7/05* (2006.01)
*A61G 5/10* (2006.01)

(52) U.S. Cl.
CPC ..... *A61G 7/1026* (2013.01); *A61G 5/10* (2013.01); *A61G 5/1091* (2016.11); *A61G 7/05* (2013.01);
(Continued)

(58) Field of Classification Search
CPC ..... A61G 7/1026; A61G 7/05; A61G 7/0502; A61G 7/1032; A61G 7/001; A61G 5/1091;
(Continued)

(56) References Cited

U.S. PATENT DOCUMENTS 5,596,775 A * 1/1997 DiMatteo ..... A61G 7/001 297/335
6,393,636 B1 * 5/2002 Wheeler ..... A61G 7/001 5/81.1 C
(Continued)

FOREIGN PATENT DOCUMENTS

JP 2008018801 A 1/2008

OTHER PUBLICATIONS

English translation of Takeshi (JP 2008/018801) (Year: 2008).*
(Continued)

*Primary Examiner* — Valerie L Woodward
(74) *Attorney, Agent, or Firm* — Meunier Carlin & Curfman LLC

(57) ABSTRACT

A slouch correction device and method for use on a seating surface of a chair or bed. The device comprises a flexible fabric sheet and a drawing mechanism associated with the fabric sheet. When actuated the drawing mechanism draws the fabric toward the back support, drawing the user's buttocks toward the back support.

18 Claims, 14 Drawing Sheets

(52) U.S. Cl.
CPC ..... *A61G 5/1056* (2013.01); *A61G 7/0502* (2013.01); *A61G 2203/12* (2013.01)

(58) Field of Classification Search
CPC ..... A61G 5/10; A61G 5/1025; A61G 5/0005; A47C 7/32; A61H 1/001; A61H 1/005; A61H 1/00
USPC ..... 297/284.4; 5/81, 81 C; 606/237
See application file for complete search history.

(56) References Cited

U.S. PATENT DOCUMENTS

| | | | | |
|---|---|---|---|---|
| 6,481,736 | B1 * | 11/2002 | Chan | A61G 5/10 280/288.4 |
| 2002/0029418 | A1 | 3/2002 | Votel | |
| 2005/0138727 | A1 * | 6/2005 | Faux | A61G 7/1019 5/81.1 R |
| 2007/0296600 | A1 * | 12/2007 | Dixon | H01R 13/6315 340/573.1 |
| 2012/0144581 | A1 * | 6/2012 | Roberg | A61G 7/1026 5/81.1 C |
| 2013/0320746 | A1 | 12/2013 | Amirault et al. | |
| 2015/0026882 | A1 * | 1/2015 | Hillenbrand, II | A61G 7/1026 5/81.1 HS |

OTHER PUBLICATIONS

Canadian Intellectual Property Office. International Search Report and Written Opinion. Application No. PCT/CA2017/000004. dated Mar. 16, 2017. 8 pages.
Office Action issued in corresponding Japanese Application No. 2018-554608, dated Oct. 12, 2020.

* cited by examiner

SLOUCH CORRECTION DEVICE AND METHOD

FIELD OF THE INVENTION

This invention relates to a slouch correction device and method. In particular, the invention relates to a device and method for correcting the posture of a person seated on a chair or the like.

BACKGROUND OF THE INVENTION

Some individuals suffer from muscle weakness, limb dysfunction or other infirmities that limit the ability to maintain or self-correct their posture when seated, particularly the elderly. Assisting the repositioning of such a person from a slouched position to an upright position on a chair or other seating surface, for example a wheelchair, poses risk of injury to both the seated person and to the person assisting, for example a caregiver.

An individual with an infirmity causing upper body weakness, referred to herein as a "patient," can end up in an uncomfortable slouched position with their lower back several inches from the back of the seat. The patient in many cases may be confined to a wheelchair, and through normal movement and motion can slip forward on the seat, resulting in poor posture that can be uncomfortable and in some cases injurious to the patient. If they are unable to lift themselves back into an upright position, it is common for a caregiver to assist with this task.

Two common methods of moving or repositioning a seated patient, for example seated in a wheelchair, involve either pulling them up from under their arms, which can result in injury to the both the caregiver and the person in the wheelchair, or reaching under the person and pulling a pillowcase or the person's belt loop or clothing toward the back of the chair. Both methods can result in back and shoulder injuries to the caregiver and a lack of dignity for the person in the wheelchair. In some environments, a person who has become slouched in a wheelchair may have to wait extended periods of time in an uncomfortable slouched position waiting for a caregiver to attend to repositioning them. Particularly in home care and in long-term care facilities and nursing homes, these interactions can happen several times a day, intensifying the lack of dignity and the lack of independence an already frail and elderly person may experience.

US Patent publication no. 20130320746 teaches a device by which a caregiver uses a belt and harness attached to a loose seat cover to pull the patient back to an upright position, using the caregiver's waist and legs to apply the necessary force while using their hands to steady the wheelchair. While this method does reduce risk of injury to the caregiver, particularly lowering the risk of injury to the back and shoulders, there is still a risk of injury to the caregiver.

Some devices function by holding the patient in an upright position in the chair, but they are designed for people with little to no control of their bodies and greatly restrict movement. Also, policies in place in most care facilities preventing the use of a belt or harness to restrict movement of a person in a wheelchair can limit or preclude the use of such methods.

There are also chairs having angled or contoured seats or seat cushions, but these do not prevent a patient from shifting into an uncomfortable slouched position.

Apparatuses configured to reposition a patient in a wheelchair are complex and restrictive, being designed to assist those who have serious mobility and/or strength issues.

Fabric sheets designed to slide in only one direction, preventing someone from sliding into a slouched position, are known. However, in attempting to prevent the patient from sliding forward the fabric can cause friction between the person's body and the sheet, increasing the risk of damage to skin integrity. Also, if the sheet is accidently placed in a backwards orientation, it will actually speed up the rate at which a patient slides forward. Risk of injuries to caregivers still exist once the person in the wheelchair has slid forward, as the caregiver must use one or more conventional techniques as described above to reposition the person into an upright position.

BRIEF DESCRIPTION OF THE DRAWINGS

In drawings which illustrate by way of example only a preferred embodiment of the invention.

DETAILED DESCRIPTION OF THE INVENTION

Figure 8:
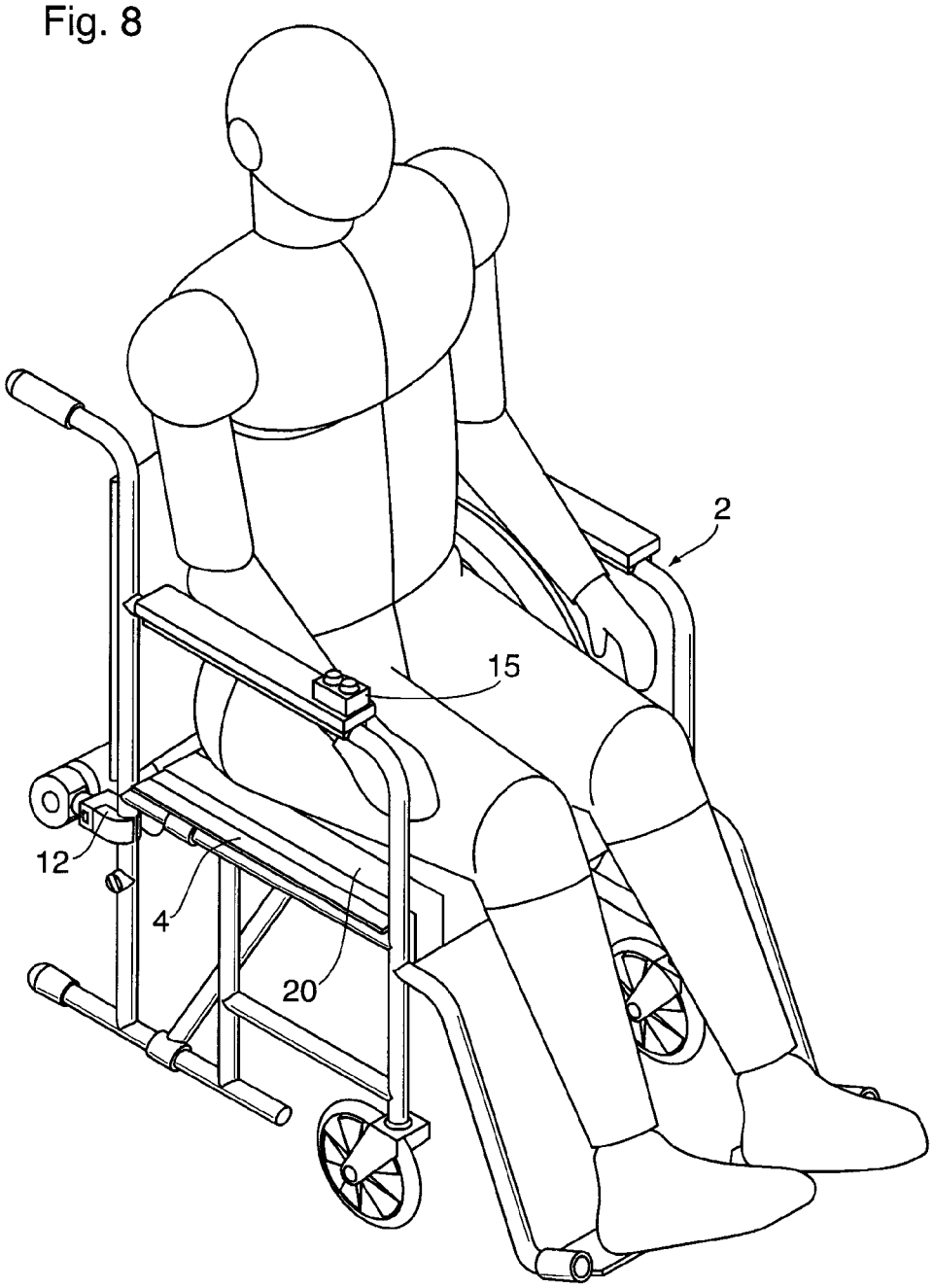
FIG. 8 is a perspective view of a patient in a wheelchair having the activating switch in a patient-accessible position.

According to the invention, a patient in a chair, for example a wheelchair 2, can reposition themselves from a slouched position to an upright position independently, or with the assistance of a caregiver, by using the device 10 of the invention. The device 10 attaches to the rear of the wheelchair 2 and is attached to a flexible fabric sheet disposed on the seat 4 of the wheelchair 2. When a switch 15 is activated the device draws the fabric sheet 20 toward the seat back 6 and rolls the sheet around the device 10, shifting the person's body toward the back of the chair. The switch 15, for example comprising at least one depressable button for activating the motor, or two depressable buttons as shown for activating the motor in both forward and reverse directions to respectively draw or slacken the fabric sheet manually, may be mounted on an accessible portion of the wheelchair 2, for example the arm as shown in FIG. 8, to allow the patient to move themselves independently, or it may be mounted somewhere else on the wheelchair 2 for use by a caregiver, for example as shown in FIG. 1.

The invention will be described in the context of a patient in a wheelchair, however the device and method of the invention can be applied to any chair, or other seating surface for example a hospital bed having a back support, and is not limited to the specific environment described and illustrated herein by way of non-limiting example of one embodiment of the invention. One of the wheelchair's wheels has been removed in some of the figures to avoid obscuring the components described herein.

Figure 1:
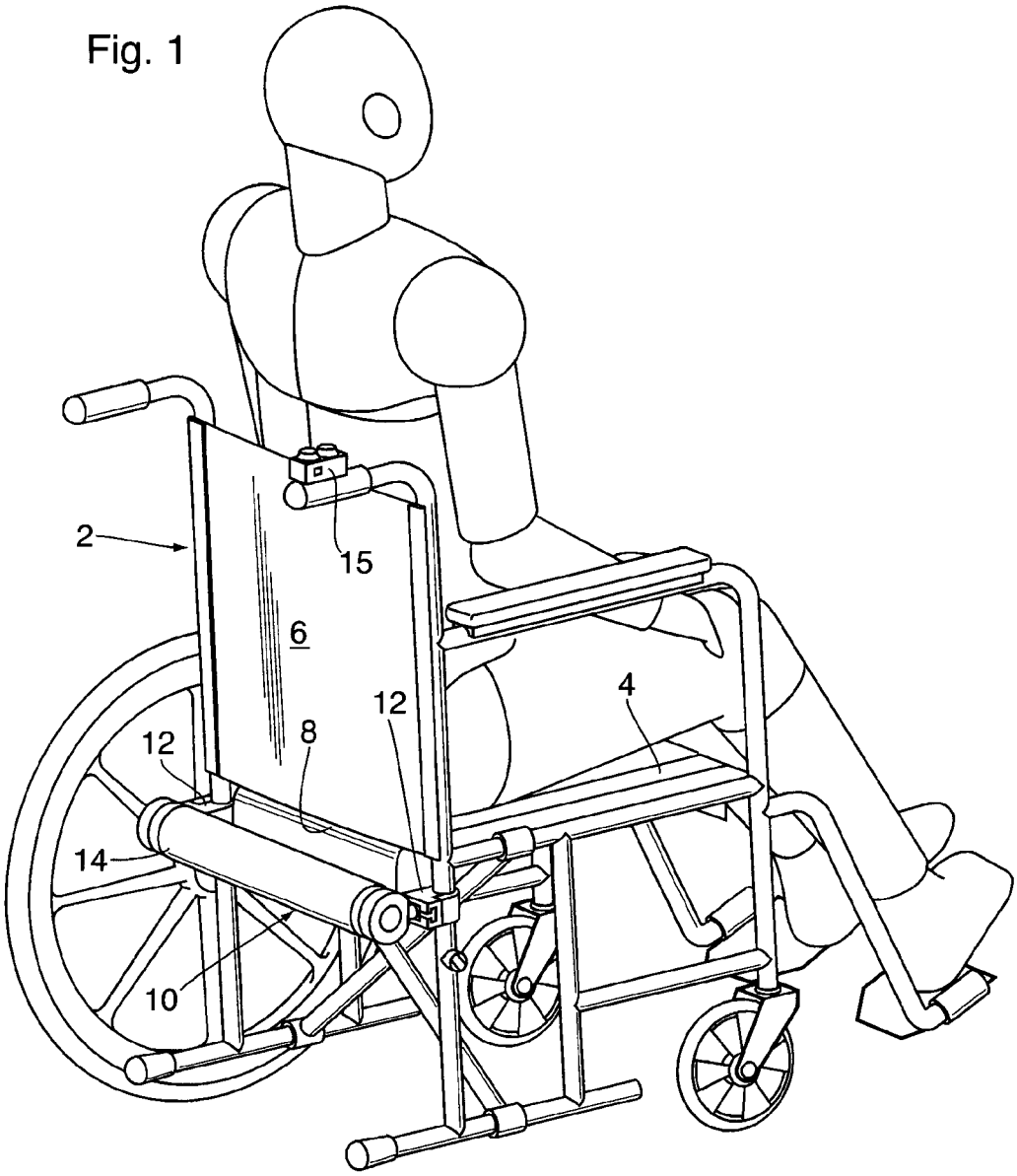
FIG. 1 is a perspective view of a patient in a wheelchair employing the device of the invention.
Figure 2:
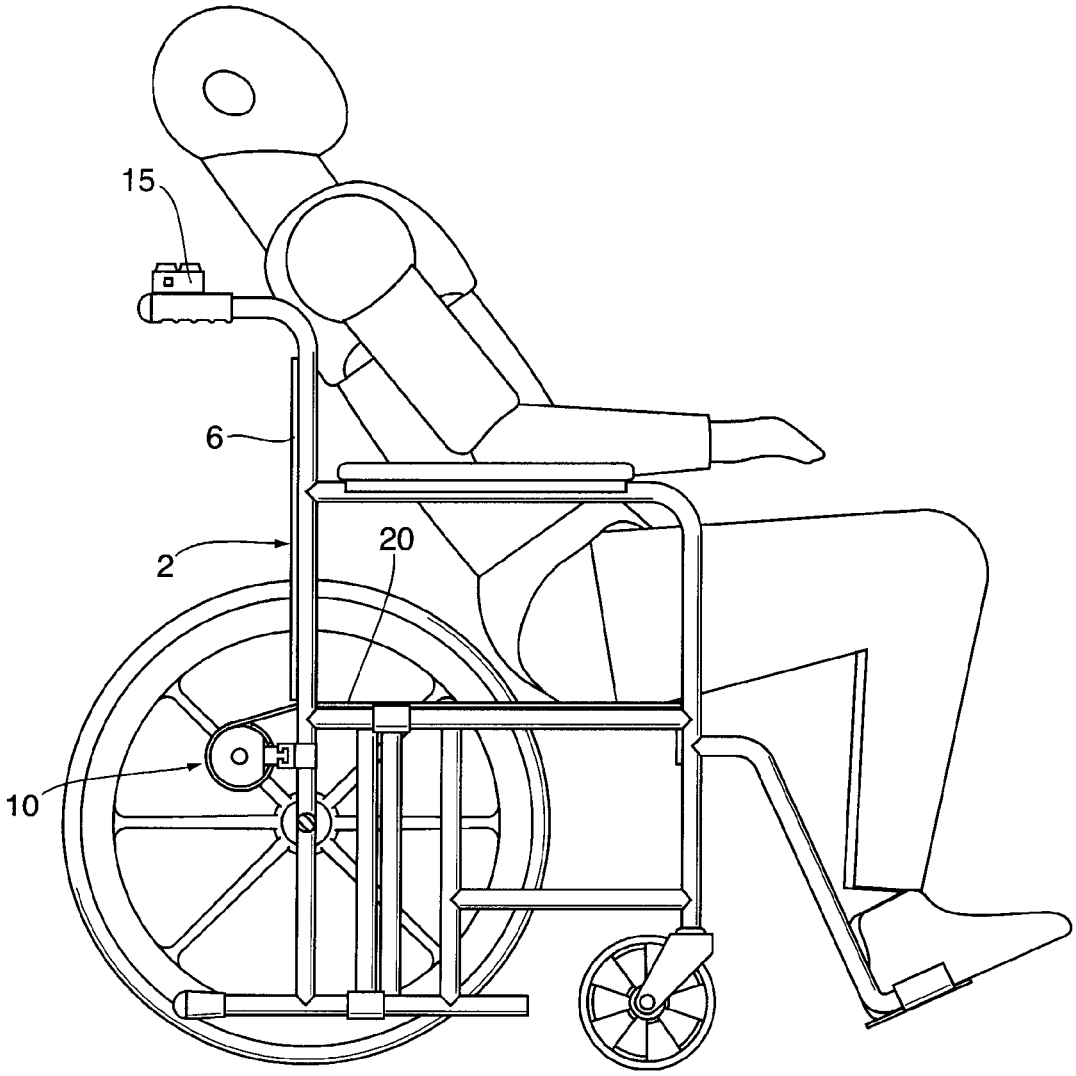
FIG. 2 is a side elevation of a patient in a slouched position on a wheelchair.
Figure 3:
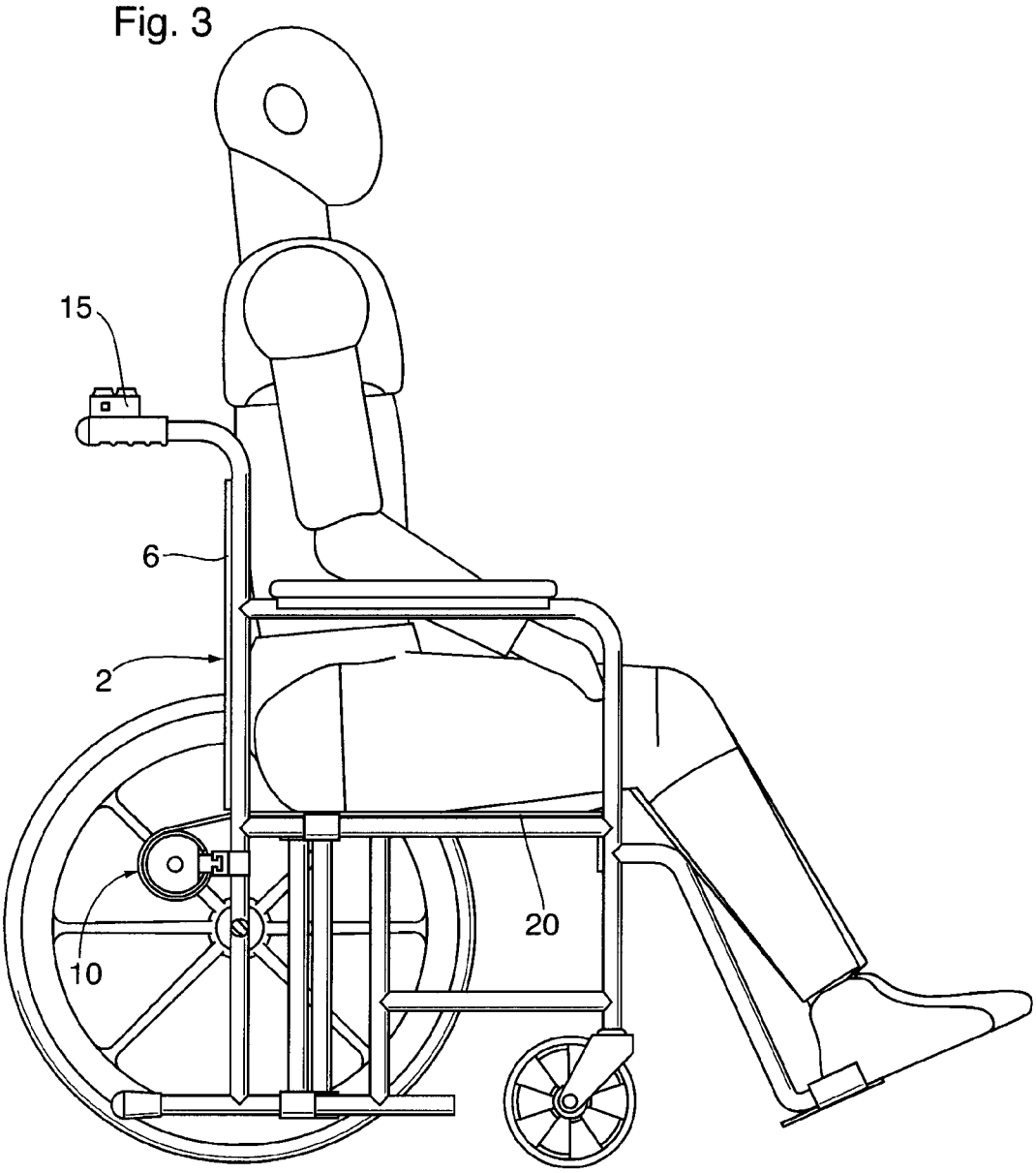
FIG. 3 is a side elevation of the patient in FIG. 2 repositioned to an erect position on the wheelchair.
Figure 4:
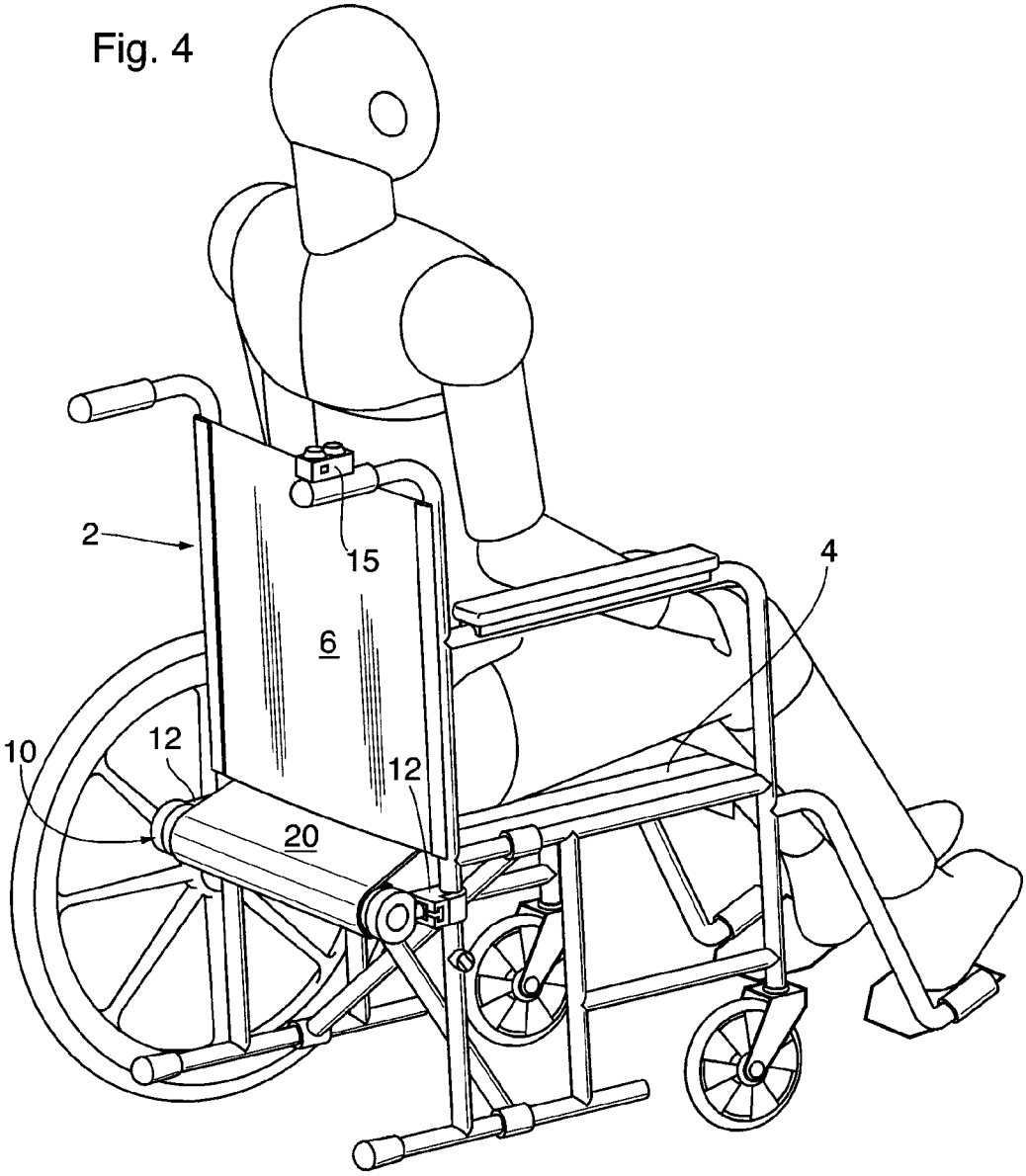
FIG. 4 is a perspective view of the repositioned patient in FIG. 3.

The device 10 of the invention may be attached to a wheelchair 2 as illustrated in FIGS. 1 to 3, adjacent to a space 8 between the chair seat 4 and the chair back support 6, for example by brackets 12 disposed at each side of the device affixed to the frame of the chair 2, for example as by bolts or any other suitable fastener. Wing nuts may be used to make the device 10 readily detachable.

The device 10 comprises a drawing mechanism comprises an exterior drum 14 associated with a flexible fabric draw sheet 20, for drawing the sheet 20 toward the back support 6 through a space 8 between the seat 4 and the back support 6. The drum 14 also serves as a housing for the mechanical components. In the mobile embodiment illustrated the brackets 12 and drum 14 may be formed from aluminium for purposes of reducing the weight of the device 10.

The draw sheet 20 may be formed from any suitable material capable of sliding on the seat 4 with some frictional resistance and strong enough to resist stretching or tearing when moving the patient, for example a blend of 55% polyester and 45% cotton. The sheet 20 should be long enough to allow for a range of front-to-back motion, preferably in the range of about 6" to 12" so and thus, depending upon the depth of the chair seat, about 36" to 42" overall in order to ensure that when fully retracted the sheet 20 remains under the user's buttocks and when fully extended the sheet does not extend so far beyond the front edge of the seat 6 as to interfere with the operation of the chair.

Figure 5A:
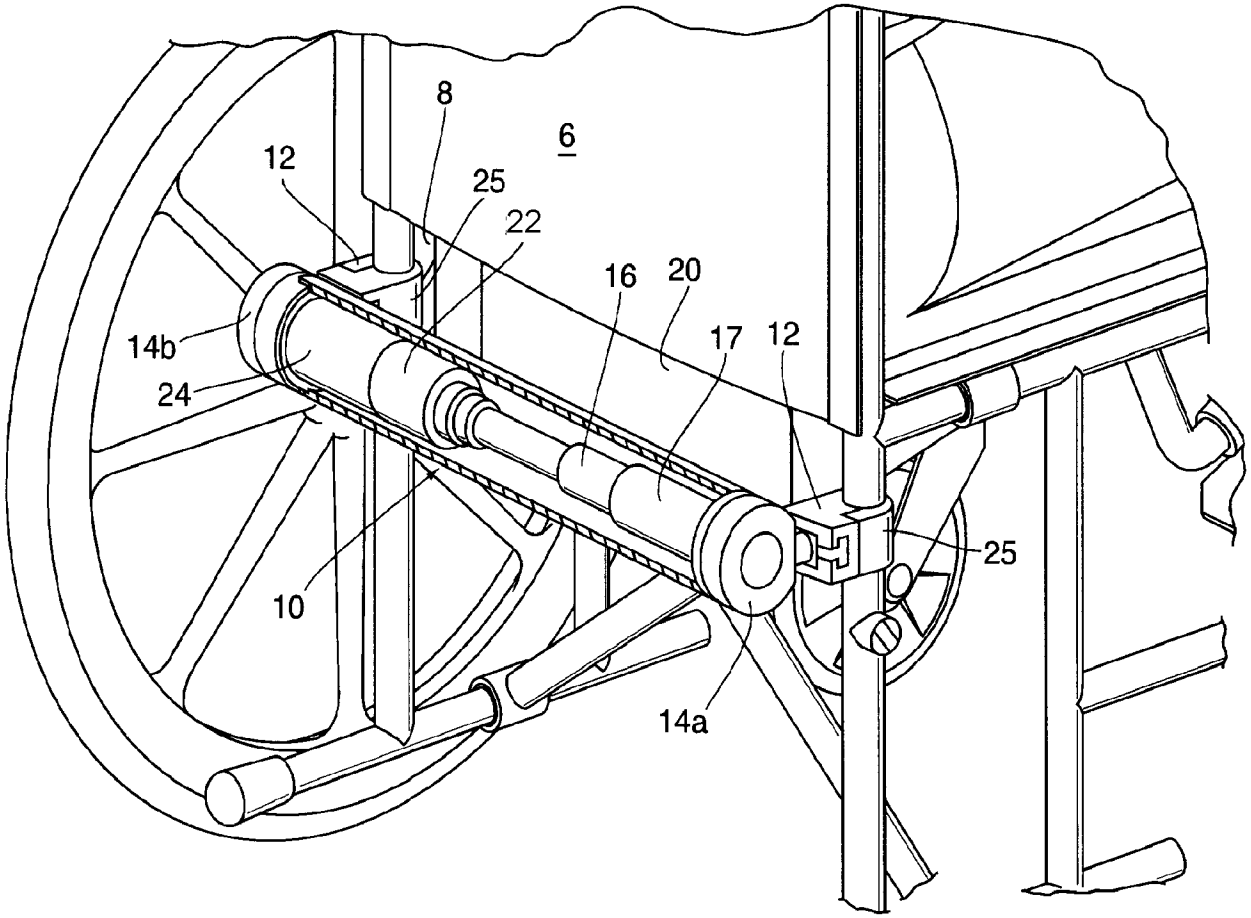
FIG. 5A is a perspective cutaway view of the repositioning mechanism.
Figure 5B:
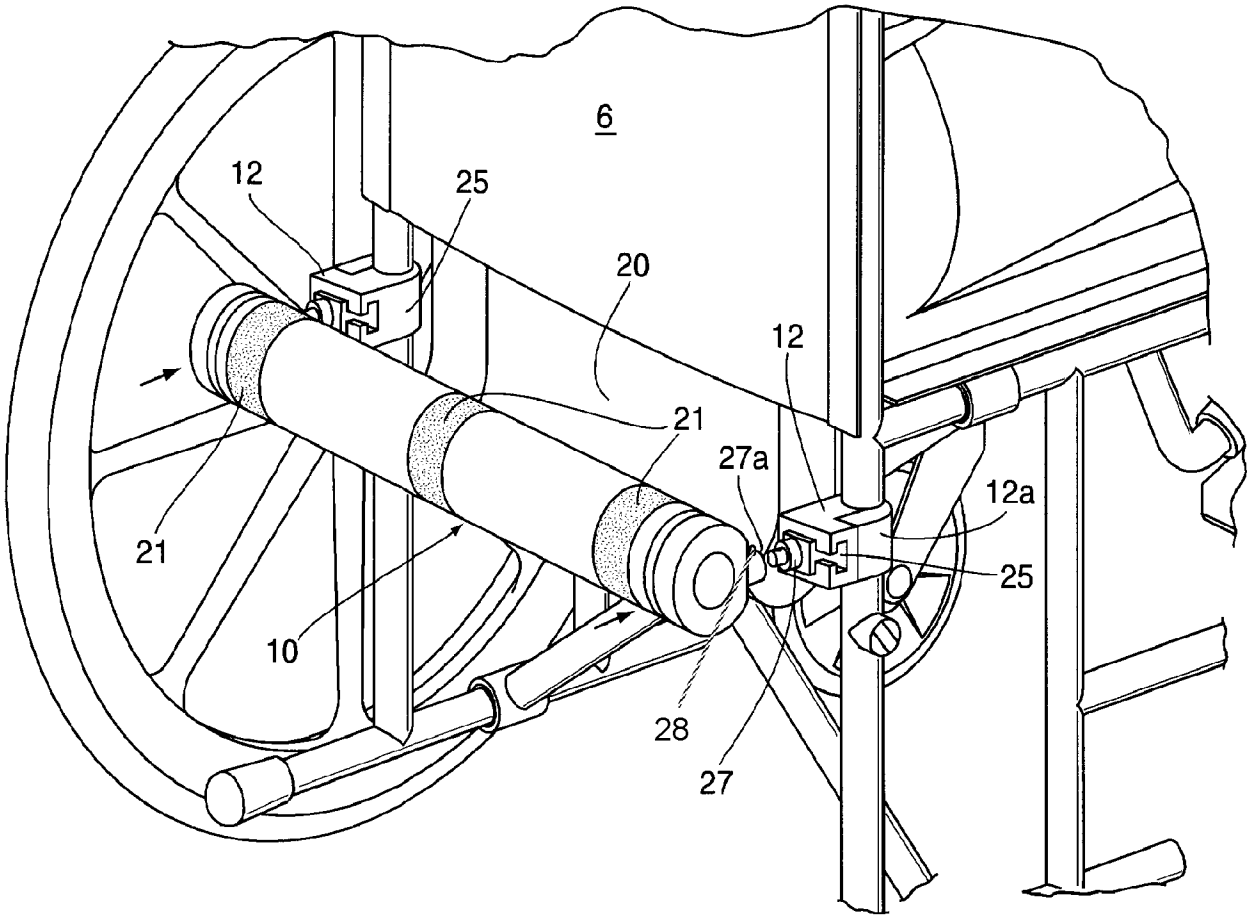
FIG. 5B is a perspective cutaway view of the repositioning mechanism with the right-hand bracket removed to show the drive shaft.

The drawing mechanism, best seen in FIGS. 5A and 5B, comprises a motor 16 operatively associated with the drum 14 so as to rotate the drum 14 when the motor 16 turns. In the case of a wheelchair 2 the motor 16 may be powered by one or more cells, for example a 12V battery 24 comprising a series of three 4V lithium ion battery cells, to allow for mobility. The battery 24 may be located at one end of the drum 14 and an exposed charging port (not shown) may be disposed through the end cap 14*b* (see FIG. 5A) to charge the battery 24.

The motor 16 is fixed in a stationary position by the bracket 12 adjacent to the motor 16, and drives a gear train (not shown) with a high gear ratio contained within gearbox housing 17, to rotate the drum slowly via a gearbox housing 17 fixed to the interior of the drum 14 and keyed to a drive shaft (not shown), for example having a square cross-section, keyway or flat surface) to rotationally fix the drive wheel to the drive shaft. The motor 16 is controlled by a driver circuit 22, for example an Arduino Uno (mark) processor which is programmed to drive the motor 16 in forward and reverse directions and optionally limits the range of motion of the sheet 20, however any suitable driver circuit may be used.

Physical limit members (not shown), for example complementary projections or bosses positioned at appropriate points on the motor housing and the interior of the drum 14, may optionally be provided for safety purposes, either independently or as a backup for electronic limits set by the circuitry 22. In this embodiment the circuitry 22 may provide an automatic shutoff if it detects that the motor 16 is activated but not rotating, to avoid overheating or damage to the motor 16 or gear train.

The fabric sheet 20 may be attached to the drum 14 by hook and loop (for example Velcro) fastener straps 21 extending from one end of the sheet 20, as shown in FIG. 5B. Any other convenient manner of anchoring the drum end of the fabric sheet 20 to the drum 14 may be employed, bearing in mind that the sheet 20 is preferably easily removed from the drum 14 so that it can be washed periodically or replaced if needed.

In use, brackets 12 are disposed over projecting pins 28 (best seen in FIG. 5B in which the right-hand bracket has been removed for clarity) and affixed to either side of the wheelchair frame tubing by fasteners, for example bolts inserted through corresponding holes in the tubing with nuts threaded to the bolts to fasten the brackets 12 securely to the wheelchair frame. Optionally the brackets 12 are formed as removable hanger clamps to suspend the device 10, and allow the device 10 to be easily removed for cleaning and maintenance, or remounted to a different chair.

The clamps 12 in the embodiment shown provide a movable jaw 12*a* as shown in FIG. 5B, for example actuated by a screw (not shown) that extends and retracts the jaw for purposes of mounting and demounting. The pin 28 and bracket 12 adjacent to the motor 16 may be keyed (for example having a square cross-section or flat surface) to rotationally fix the motor 16 relative to the wheelchair 2. The surface of the bracket 12 to which the motor 16 mounts may provide a quick-release lug 27 engaged by a socket 27*a* affixed to a stationary end cap 14*a* or 14*b* and having a set screw for affixing the socket to the lug 27 as shown. The lug 27 may be slidably trapped in a slot 25, allowing for a range of lateral motion (for example 2 inches) while the lug 27 remains trapped in the slot 25, to accommodate slight differences in the widths of different wheelchairs. The motor 16 itself can also be made in different sizes to accommodate larger differences in the widths of different wheelchairs.

Figure 6:
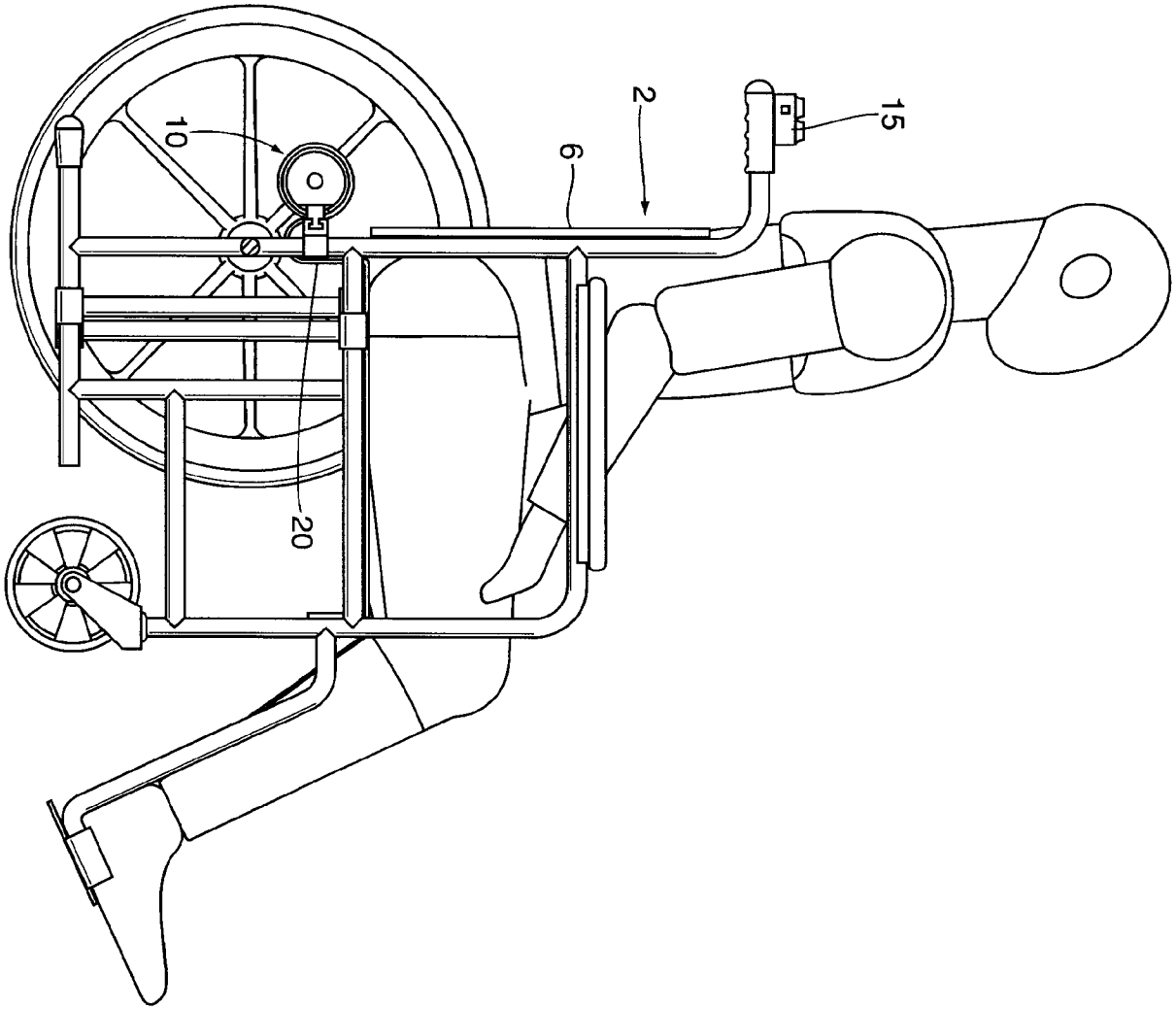
FIG. 6 is a side elevation of a patient in an erect position on a wheelchair with slack in the repositioning fabric.

The sheet 20 is disposed through the space 8 between the seat 4 and the back support 6. When the patient has slipped forward to an uncomfortable slouched position, as shown in FIG. 2, the patient can activate the switch 15 sending a signal to the motor controller circuitry 22 which activates the motor to draw the sheet 20 toward the back support 6. The gear train (not shown) reduces the motor's speed while increasing the torque output. The drive shaft is driven by the gear train and transmits the torque to the drive wheel, which is fixed to the drum 14 and thus causes the drum 14 to rotate. This rotation reels in the fabric 20, drawing the patient to the erect position illustrated in FIG. 3. Once the user is in an erect position, the user can deactivate the switch 15, which signals the drive circuitry 22 to stop the motor 16 from turning.

in the preferred embodiment the drive circuitry 22 completes a cycle of drawing the fabric sheet 20 to correct the patient's slouch and then automatically pays out the sheet 20 to complete the cycle. For example, the device may be programmed to pause for a set interval after repositioning the patient, for example a few seconds, and then drive the motor 16 in the reverse direction for substantially the same number of rotations as the drawing cycle, unreeling the fabric sheet 20 as shown in FIG. 6 (the right-hand wheel of the wheelchair 2 having been removed in FIG. 6 for clarity). This slackens the fabric sheet 20 so that as the patient slides forward the fabric sheet 20 is free to move with the patient. This prevents the device 10 from running out of sheet 20 to draw after successive repositioning cycles, and also avoids discomfort due to friction.

Alternatively a wireless remote control 60, for example operating via infrared, BLUETOOTH™ or any other suitable wireless system, may be provided for the patient or a caregiver to operate, for example through an antenna disposed within the drum 14.

Figure 12:
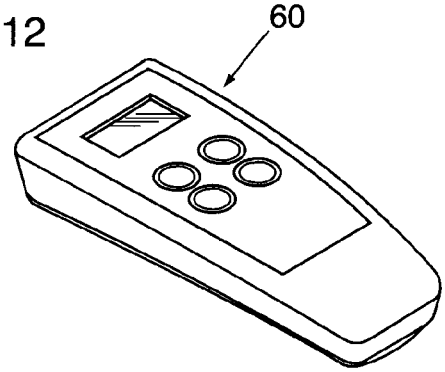
FIG. 12 is a perspective view of a remote control for activating the motor 16.
Figure 7:
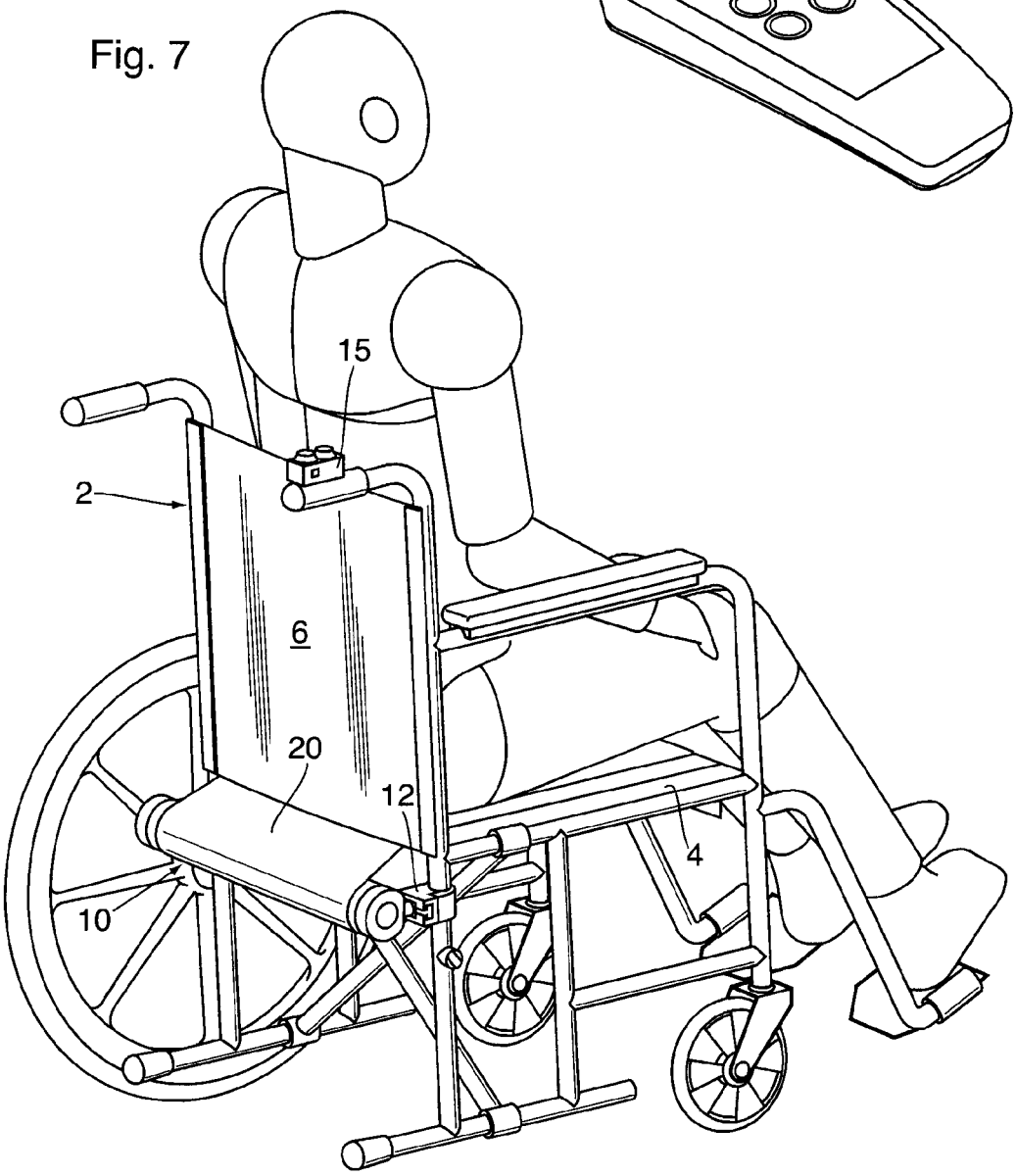
FIG. 7 is a perspective view of the patient in the wheelchair of FIG. 6.

As shown in FIG. 12, the remote control 60 preferably provides a "Shift" button to activate the electronics in the drum 14, rotating the drum 14 to reposition the wheelchair user and/or the fabric sheet 20. The "Stop" button stops the motor 16 at any point. If the "Reset" button is depressed when the drum 14 is in 'stop' mode the drum 14 will rotate back to the home position, so the patient can still freely move. The "Data" button may display one or more of the time, battery life for the remote control 60 and drum 14, how many times a patient has been repositioned in a specified interval (for example one day), and/or how long repositioning occurred after a specified interval (for example 60 minutes) from the last repositioning or reset. The data may be reset by the user holding the "Reset" button for a predetermined period, however it may be beneficial to prevent certain data from being deleted, for example the time elapsed from the last repositioning or reset, without professional support (for example PIN or password protected). External or internal software can be provided to analyze data from the remote control 60 and provide key data back to the caregiver.

Figure 14:
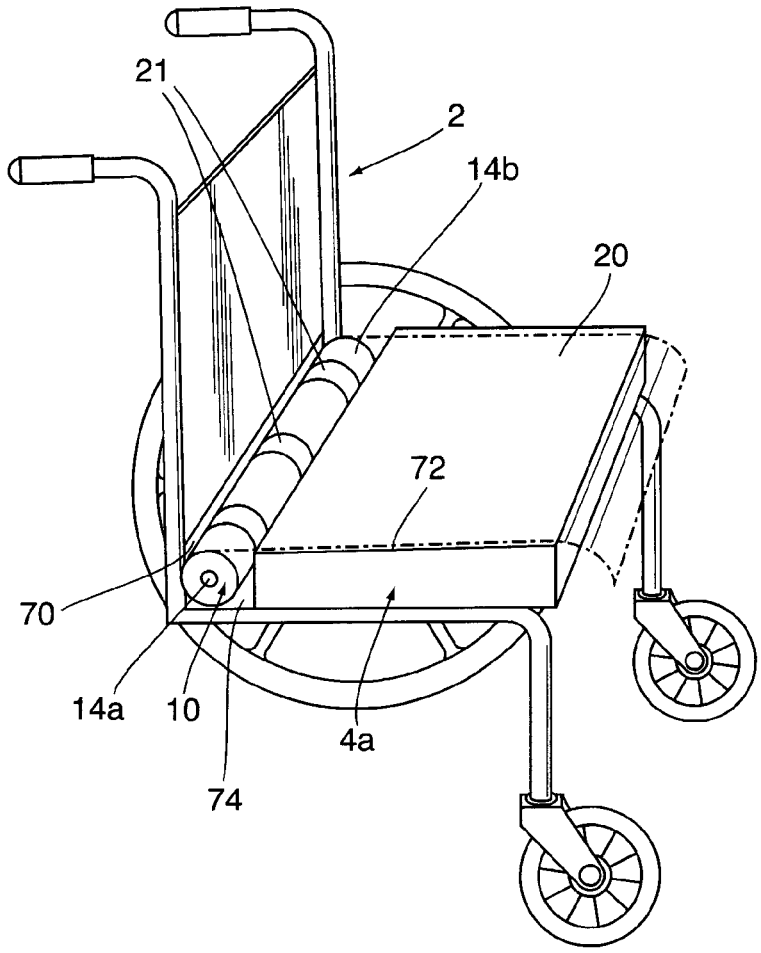
FIG. 14 is a perspective view of a wheelchair embodying a device according to the invention integrated into the seat cushion.

A device 10 according to the invention could alternatively be integrated into the seat cushion 4*a* of the wheelchair 2 (or a stationary chair), as shown in FIG. 14 (the right-rear wheel has been removed from the figure for purposes of illustration). In the embodiment shown a back panel 70 is affixed to side stiffener panels 72 which are in turn affixed to the cushion 4*a*, forming a recess 74 in which the drawing mechanism 10 is seated with end caps 14*a*, 14*b* affixed in any suitable fashion to the back panel 70 or the side stiffener panels 72. The cushion 4*a* in the embodiment shown is thick enough to house the drawing mechanism 10, and preferably self-supporting so as to be removable from the wheelchair 2, so the side stiffener panels 72 are optionally provided to prevent the cushion 4*a* from collapsing under the drawing force of the drawing mechanism 10. Alternatively a perimeter stiffener wire or other stiffening member (not shown) could be built into the cushion 4*a* to maintain its rest shape while the drum 14 is rotating. The device 10 can otherwise be configured and designed to operate as described above.

Figure 9:
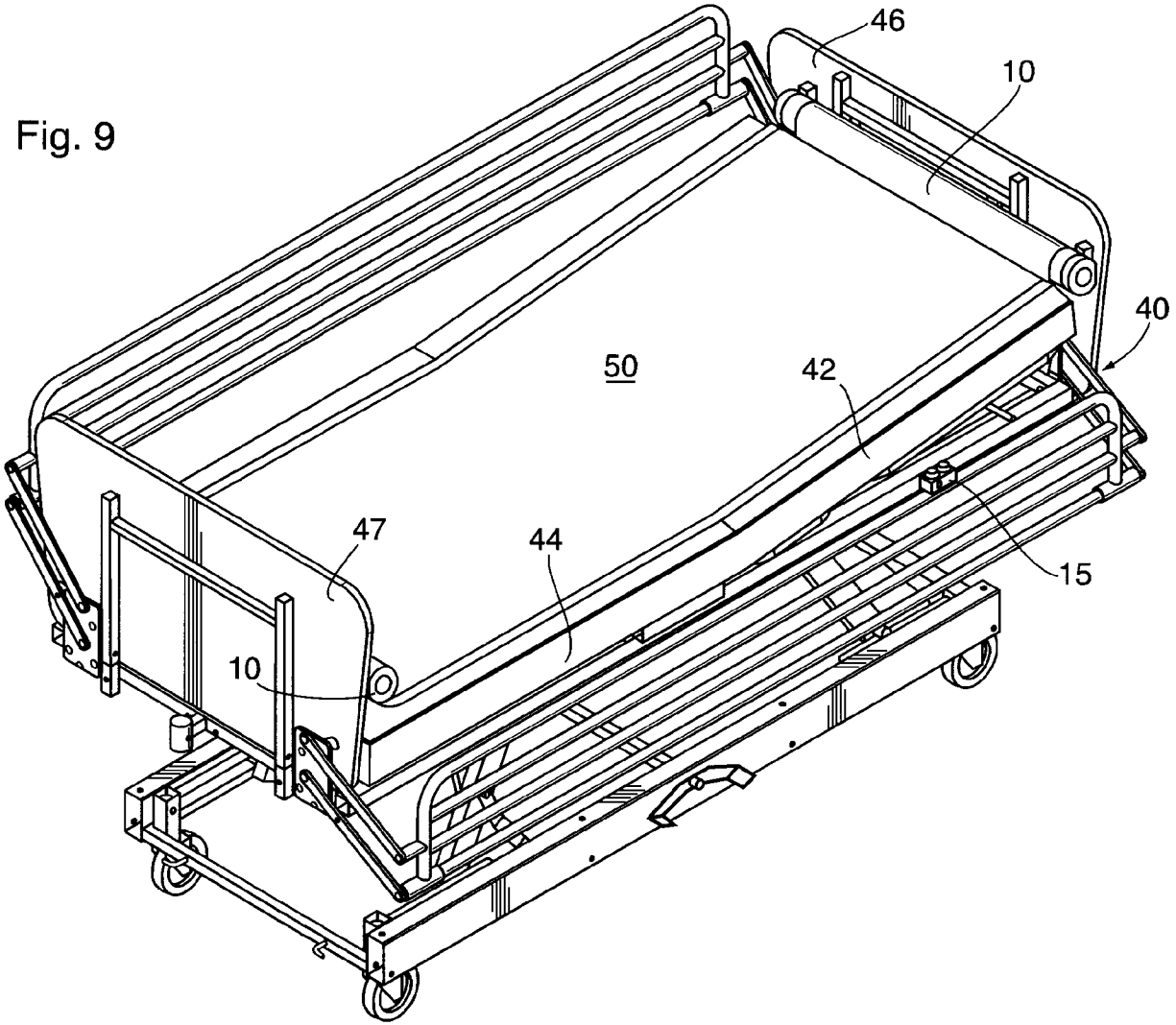
FIG. 9 is a perspective view of a hospital bed providing a device of the invention at each of the head end and foot end of the bed.
Figure 10:
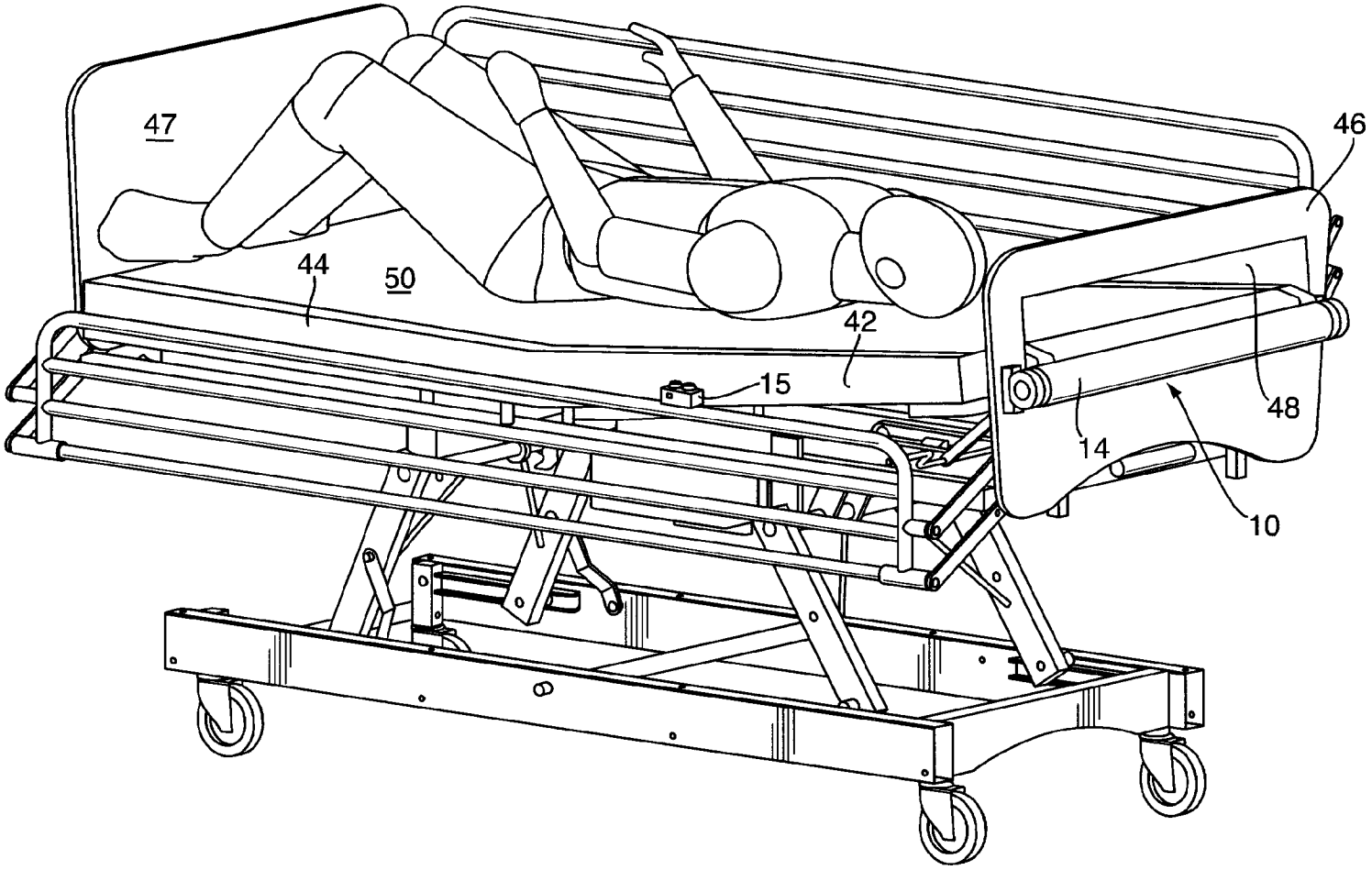
FIG. 10 is a perspective view of a further embodiment of a hospital bed providing the device of the invention only at the head end of the bed, showing the patient in a slouched position.
Figure 11:
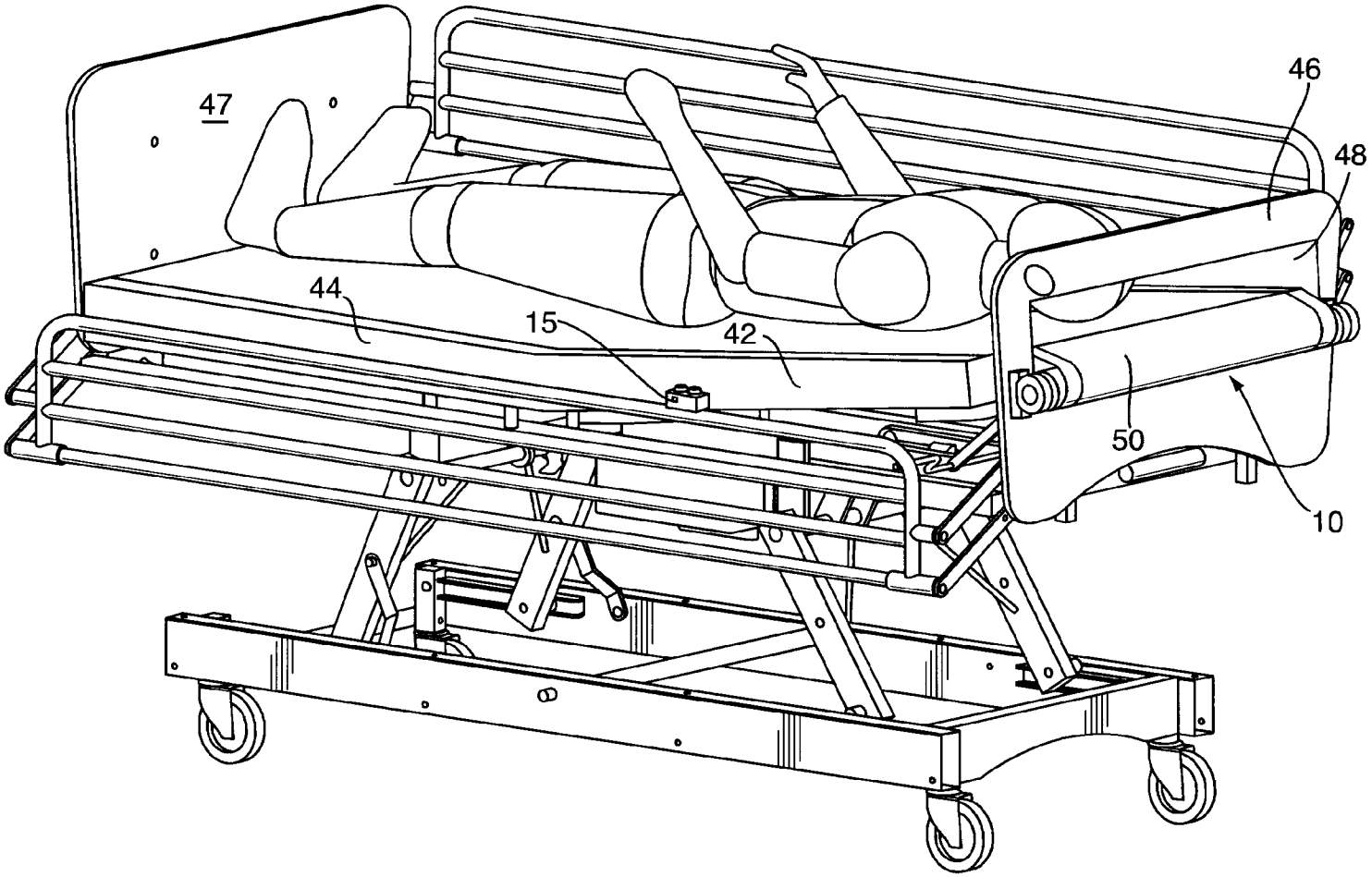
FIG. 11 is a perspective view of the hospital bed of FIG. 10 showing the patient in a corrected recumbent position.
Figure 13:
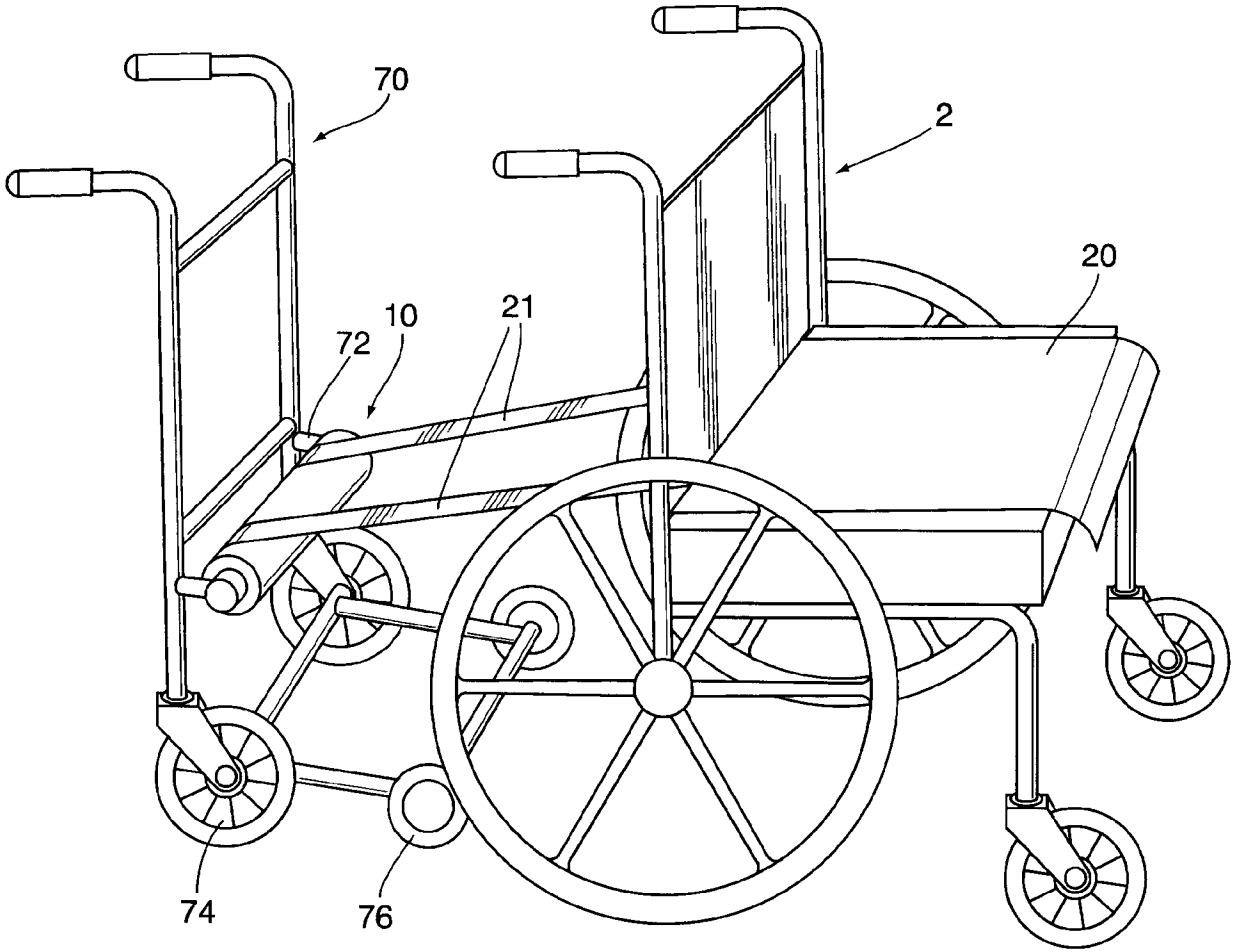
FIG. 13 is a perspective view of a frame for externally supporting the device of the invention behind a chair that is not configured for ready attachment of the device to the chair itself.

A further embodiment of the invention, for a wheelchair or other chair that does not lend itself to retro-fitting the device 10 to the chair itself, is illustrated in FIG. 13. The device 10 in this embodiment is affixed to a drum holder 72 of an external frame 70. The drum holder 72 is movable vertically along the frame 70 and/or disposed at a height that will allow the sheet 20 to extend over the seat of the wheelchair 2 to be drawn and payed out as needed. For mobility the frame 70 is provided with wheels 74, 76 to be easily moved into position as a cart or trolley, the wheels 74, 76 being provided with brakes to fix the frame 70 in position behind the wheelchair 2, as shown in FIG. 13. In this embodiment the straps 21 affixing the sheet 20 to the drum 14 may be longer so that the frame 70 can be positioned a safe distance behind the wheelchair 2, as shown in FIG. 13. FIGS. 9-11 illustrate embodiments of the invention for use in a hospital bed 40. The bed 40 comprises a frame supporting a motor-driven torso support portion 42 and a stationary leg support portion 44 maintained in a level orientation. The torso support portion 42 is able to be inclined within a range of recumbent positions for the comfort of the patient by activating the motor (not shown), as is well known.

The device 10 is mounted to the headboard 46, and the fabric sheet 50 is extended over the mattress, preferably (but not necessarily) along the entire length of the bed 50. The switch 15 is disposed in a convenient position for activation by the patient or the caregiver, as desired. The operation of the device 10 is the same as in the above-described wheelchair embodiment. FIG. 10 shows a patient that has slipped to a slouched position on the bed 40, and FIG. 11 shows the patient in a corrected recumbent position following activation of the device 10 of the invention to draw the fabric sheet 50 toward the headboard 46 and reposition the patient with their hips general over the hinge point of the torso and leg support portions 42, 44.

In the embodiment of FIG. 9 the device 10 is mounted on an inside surface of each of the headboard 46 and footboard 47. In the embodiment of FIGS. 10 and 11 the device 10 is mounted only on an outside surface of the headboard 46, a space 48 being provided through which the fabric sheet 50 extends in order to cover the mattress. Mounting a second device 10 to the footboard 47 at the foot of the bed 40 allows the patient to be drawn in either direction along the length of the bed. The second device at the foot end 47 works in tandem with the device 10 located at the head end 46 of the bed 40, one pulling the sheet 50 and the other paying out the sheet 50 at substantially the same rate, maintaining the sheet 50 taught throughout the repositioning cycle. However a single device 10 mounted at the head end 46 of the bed 40 also works, and as in the embodiments described above in connection with a wheelchair the drive circuitry 22 preferably completes a cycle of drawing the fabric sheet 50 to correct the patient's slouch and then automatically pays out the sheet 20 to complete the cycle.

Various embodiments of the present invention having been thus described in detail by way of example, it will be apparent to those skilled in the art that variations and modifications may be made without departing from the invention. The invention includes all such variations and modifications as fall within the scope of the appended claims.

The invention claimed is:

1. A slouch correction device for use with a user support for supporting a user comprising a seating surface associated with a back support, the slouch correction device comprising:

a flexible fabric sheet having a fixed end and a downstream end, a drawing mechanism to be associated with the user support rearwardly of the seating surface and attached to the fixed end of the fabric sheet, for drawing the fabric sheet when the fabric sheet is on the seating surface toward the back of the seating surface, and a switch for manually actuating the drawing mechanism through a drawing cycle to draw the fabric sheet when the user is in a slouched position, whereby when the user is in a slouched position with the fabric sheet disposed on the seating surface beneath the user, actuating the drawing mechanism slides the user along the seating surface out of the slouched position to correct posture of the user, wherein the drawing mechanism is configured to, after sliding the user along the seating surface out of the slouched position and while the user is out of the slouched position, automatically pay out the fabric sheet for substantially the same distance as the fabric sheet had been drawn during the drawing cycle thereby to slacken a portion of the fabric sheet that is between the drawing mechanism and the user, wherein slackening of the portion of the fabric sheet enables, during a subsequent sliding by the user from out of the slouched position into the slouched position, the fabric sheet to slide with the user freely with respect to the drawing mechanism along the seating surface for substantially the same distance as the fabric sheet had been paid out.

2. The slouch correction device of claim 1 wherein the drawing mechanism is configured to conduct rotations in a first direction thereby to draw the fabric sheet and to automatically conduct substantially the same number of rotations as the drawing cycle in a second, opposite direction thereby to pay out the fabric sheet.

3. The slouch correction device of claim 1 wherein the seating surface and back support form part of a chair.

4. The slouch correction device of claim 1 wherein the seating surface and back support form part of a bed.

5. The slouch correction device of claim 1 wherein the drawing mechanism is positionable behind the back support and the fabric sheet is dimensioned to extend through a space between the back support and the seating surface of the user support.

6. The slouch correction device of claim 5 wherein the drawing mechanism is affixable to the user support adjacent to the space.

7. The slouch correction device of claim 6 wherein the drawing mechanism comprises clamps affixable to a frame of the user support, the clamps being releasable from the drawing mechanism.

8. The slouch correction device of claim 7 wherein the drawing mechanism comprises end caps supported by the clamps in fixed relation and a drum rotatably affixed to the end caps, the drum containing a motor for selectively rotating the drum relative to the end caps.

9. The slouch correction device of claim 1 wherein the drawing mechanism is integrated into the seating surface.

10. The slouch correction device of claim 1 wherein the fabric sheet is affixed to the drawing mechanism by one or more releasable fasteners.

11. The slouch correction device of claim 1, wherein the switch is integrated with a remote control for actuating the drawing mechanism, wherein the remote control is operable to display data related to repositioning of the user.

12. A slouch correction method for use with a user support comprising a seating surface associated with a back support, the slouch correction method comprising the steps of:

disposing on the seating surface a flexible fabric sheet having a fixed end and a downstream end, disposing a drawing mechanism rearwardly of the seating surface and attached to the fixed end of the fabric sheet, responsive to manual actuation of a switch, actuating the drawing mechanism to draw the fabric sheet toward the back of the seating surface through a drawing cycle when a user supported on the user support is in a slouched position, whereby when the user is in a slouched position with the fabric sheet disposed on the seating surface beneath the user, actuating the drawing mechanism slides the user along the seating surface out of the slouched position to correct the user's posture, and after sliding the user along the seating surface out of the slouched position, while the user is out of the slouched position, automatically paying out the fabric sheet for substantially the same distance as the fabric sheet had been drawn thereby to slacken a portion of the fabric sheet that is between the drawing mechanism and the user, wherein slackening of the portion of the fabric sheet enables, during a subsequent sliding by the user from out of the slouched position into the slouched position, the fabric sheet to slide with the user freely with respect to the drawing mechanism along the seating surface for substantially the same distance as the fabric sheet had been paid out.

13. The slouch correction method of claim 12, wherein the drawing mechanism is configured to conduct rotations in a first direction thereby to draw the fabric sheet and to automatically conduct substantially the same number of rotations as the drawing cycle in a second, opposite direction thereby to pay out the fabric sheet.

14. The slouch correction method of claim 12 wherein the seating surface and back support form part of a chair.

15. The slouch correction method of claim 12 wherein the seating surface and back support form part of a bed.

16. The slouch correction method of claim 12 wherein the drawing mechanism is disposed behind the back support, further comprising prior to the actuating:

disposing the fabric sheet through a space between the back support and the seating surface.

17. The slouch correction method of claim 12, wherein the drawing mechanism is affixed to a cart disposed behind the user support.

18. The slouch correction method of claim 12, further comprising recording data related to repositioning of the user.

* * * * *